US006840820B2

(12) United States Patent
Oda

(10) Patent No.: US 6,840,820 B2
(45) Date of Patent: Jan. 11, 2005

(54) ELECTRICAL CONNECTOR BOX AND ASSEMBLY METHOD THEREOF

(75) Inventor: Akihiro Oda, Yokkaichi (JP)

(73) Assignee: Sumitomo Wiring Systems, Ltd., Yokkaichi (JP)

( * ) Notice: Subject to any disclaimer, the term of this patent is extended or adjusted under 35 U.S.C. 154(b) by 0 days.

(21) Appl. No.: 10/642,296

(22) Filed: Aug. 18, 2003

(65) Prior Publication Data

US 2004/0033731 A1 Feb. 19, 2004

(30) Foreign Application Priority Data

Aug. 19, 2002 (JP) ..... 2002-238498

(51) Int. Cl.[7] ..... H01R 11/09
(52) U.S. Cl. ..... 439/724; 439/721
(58) Field of Search ..... 439/721, 723, 439/724, 949, 715, 717

(56) References Cited

U.S. PATENT DOCUMENTS 4,577,917 A * 3/1986 Nashimoto et al. ..... 439/655
5,160,274 A * 11/1992 Ozaki et al. ..... 439/212
5,207,591 A * 5/1993 Ozaki et al. ..... 439/212
5,295,847 A * 3/1994 Ozaki et al. ..... 439/212
5,322,445 A * 6/1994 Ozaki et al. ..... 439/212
5,624,280 A * 4/1997 Kato ..... 439/724
5,707,254 A * 1/1998 Chishima et al. ..... 439/679
5,718,047 A * 2/1998 Nakayama et al. ..... 29/895
5,782,652 A 7/1998 Feher et al.
5,908,322 A * 6/1999 Seki ..... 439/212
6,022,247 A * 2/2000 Akiyama et al. ..... 439/701
6,322,376 B1 * 11/2001 Jetton ..... 439/76.2
6,383,035 B1 * 5/2002 Kasai ..... 439/724
6,661,672 B2 * 12/2003 Ito ..... 361/752

FOREIGN PATENT DOCUMENTS

JP 61277180 12/1986

* cited by examiner

*Primary Examiner*—Ross Gushi
(74) *Attorney, Agent, or Firm*—Greenblum & Bernstein, P.L.C.

(57) ABSTRACT

An electrical connector box that provides multiple electrical circuit connections, simplifies alterations to circuit connection patterns, and allows for convenient continuity testing. The electrical connector box includes a housing and a holder that contains multiple vertically stacked receptacles. Multiple bus bars, of which multiple bus bar tabs are an integral part thereof, are press fit into the housing at uniform intervals, a block connector is inserted into each of vertically stacked receptacles in the holder, and the housing and holder are locked together during which the bus bar tabs in the housing are inserted into female terminal connectors held within the block connectors in the holder.

15 Claims, 5 Drawing Sheets

ELECTRICAL CONNECTOR BOX AND ASSEMBLY METHOD THEREOF

BACKGROUND OF THE INVENTION

1. Field of the Invention

The present invention relates to an automotive electrical connector box and a method of assembly of an automotive electrical connector box, and more particularly, to an electrical connector box that connects multiple circuits, is easy to assemble, and is configured for a simple continuity testing method.

2. Description of Related Art

Japanese Kokai Patent S61-277180 describes a structure for a connector box which is illustrated in FIG. 5. The connector box includes a housing 1 having a closed end and into which joint bus bars 2 are fixedly installed with bus bar tabs 2*a* extending toward an open end of housing 1. When block connector 3 is inserted into housing 1, the female terminal connectors (to which wire ends are attached) held in block connector 3 join to tabs 2*a*, thus establishing an electrical connection between the female terminal connectors according to the configuration of bus bars 2.

This type of conventional connector box requires that the wires to be connected are initially inserted into and anchored to a single connector, thus restricting the freedom with which the circuit connection pattern can be laid out, and often necessitating that long lengths of wires be used. Moreover, this design does not lend itself well to modifying circuit connections due to the necessity of changing the wires in the block connectors if an alteration in the wire connection pattern is desired.

Furthermore, as this design specifies a single connector box housing to which only a single block connector may be inserted, the number of circuits connected by the box is limited by the number of wires that can be installed into the block connector. This limitation requires the use of a large number of connector boxes to make the necessary connections throughout the wiring harness, thus complicating the wire harness assembly process.

SUMMARY OF THE INVENTION

Taking the above-described drawbacks into consideration, the present invention provides an improved electrical connector box constructed to allow easy alteration of circuit connections, to reduce the number of locations where wires are connected in the wiring harness, and to simplify the wire harness assembly procedure.

The electrical connector box of the present invention includes a housing into which bus bars are press fit, block connectors that contain wire terminal connectors attached to the ends of wires, and a holder into which the block connectors are installed within vertically stacked receptacles.

The bus bars, each including a connector band from which bus bar tabs project at uniform intervals, are press fit into the housing in the vertical or Y-axis direction and spaced at uniform intervals along the horizontal or X-axis direction.

Each of the block connectors contains a single row of terminal sockets. A female terminal connector having a wire end attached thereto may be inserted and locked into each terminal socket.

The block connectors are individually installed into vertically stacked receptacles in the holder, the receptacles being defined by partition walls that divide the internal space of the holder.

A structure is thus formed whereby the mutual joining of the holder and housing results in the bus bar tabs on the housing side inserting and joining to the female terminal connectors in the block connectors on the holder side.

The present invention provides multiple block connectors that are installed in the holder in a vertically stacked arrangement, and bus bars, fixedly installed in the housing, that are joined to the female terminal connectors in the block connectors, thus forming electrical connections between the block connectors.

Because the wires in a single block connector are not mutually connected by the same bus bar, the wires for connection need not be placed in the same block connector. Therefore, the wires in the block connector need not be changed if an alteration in the circuit connection pattern is desired. In other words, circuit connection patterns can be changed by simply severing the bus bars at appropriate locations between the bus bar tabs without making any changes to the wires in the block connectors.

Moreover, because all of the wire-holding block connectors are installed within a single holder, and because the bus bars are installed in the housing in an arrangement that places the bus bar tabs at uniform intervals in horizontal and vertical grid-type alignment, a single connector box is able to provide the connections required for a large number of circuits. The function of multiple connector boxes can thus be incorporated into a single connector box to eliminate the conventional requirement that multiple connector boxes be used at various locations throughout the wiring harness.

Furthermore, even though all connections are made through a single connector box, the wires to be mutually connected need not be installed in the same block connector, but may be joined through their placement in any of the block connectors installed in the holder, thus allowing the lengths of the wires for connection to be shortened. Moreover, changes in circuit connection patterns can be easily executed because all connections are made within a single connector box.

When the holder, which holds the block connectors, each block connector containing multiple wires to be variously connected, is inserted in the housing, the bus bar tabs attached to the housing simultaneously are joined to the female terminal connectors held in the block connectors, thus forming multiple circuit connections through a fast and simple connector box assembly procedure.

To describe the structure in more detail, lock tabs, which are provided on both sides of each block connector, insert and lock to lock slots formed on both sidewalls of each block connector receptacle in the holder.

The bus bars are forcibly pressed into and anchored within indents formed on the inward facing surface of the flat base plate of the housing.

Lock tabs provided on the external surfaces of opposing sidewalls of the holder engage and connect to latch frames extending from the sides of the housing base plate.

Terminal connector access ports are formed within the surface of the holder facing the housing to allow for the insertion of the bus bar tabs and continuity test probes therein.

The present invention further provides a method of assembling the connector box whereby the wire-attached female terminal connectors are inserted in the block connectors, each block connector inserted into each block connector receptacle in the holder, and a continuity test conducted by inserting a continuity test probe into each terminal socket of the block connector. The connector box is then assembled by pressing the holder against the housing and locking it thereto.

The continuity test is conducted by inserting a continuity test probe into each terminal socket with the block connectors already inserted in the holder. This eliminates the need to install each block connector in a continuity test jig, thereby eliminating the continuity test jig and thus improving the continuity test procedure.

An aspect of the present invention provides an electrical connector box including a housing, a plurality of bus bars press fit into the housing, wherein each bus bar includes a connector band and a plurality of bus bar tabs extending therefrom at first uniform intervals and each bus bar is press fit into the housing so that the bus bar extends in a vertical Y-axis direction and the plurality of bus bars are spaced from each other at second uniform intervals along a horizontal X-axis direction substantially perpendicular to the vertical Y-axis direction, a plurality of block connectors configured to hold a plurality of wire terminal connectors attached to the ends of wires, each block connector including a single row of terminal sockets, each terminal socket having a female terminal connector inserted and locked therein, and a holder joined to the housing, the holder including a plurality of partition walls dividing the internal space of the holder and defining a plurality of vertically stacked receptacles therein, each receptacle configured to receive a block connector therein, wherein each block connector is individually positioned in one of the vertically stacked receptacles within the holder so that the bus bar tabs are positioned in and joined to respective female terminal connectors in the block connectors. The housing may further include a base plate having an interior surface facing the holder and a plurality of recesses provided in the interior surface, the bus bars press fit into the recesses. Further, electrical connector box may further include lock tabs provided on external surfaces of opposite sidewalls of the holder, and latch frames extending from edges of the housing base plate, wherein the lock tabs engage respective latch frames to lock the housing and the holder together. Further, the first uniform intervals between the bus bar tabs and the second uniform intervals between the bus bars are substantially equal.

According to a further aspect of the present invention, the electrical connector box may further include lock tabs provided on external surfaces of opposite sidewalls of each block connector, and lock slots extending along opposite sidewalls of each receptacle, wherein the lock tabs engage respective lock slots to lock each block connector in a respective receptacle. Further, the holder may include a rear wall having an exterior surface facing the housing and a plurality of terminal connector access ports provided in the exterior surface facing the housing, each terminal connector access ports configured to receive therein one of the bus bars tabs and a continuity test probe. Each bus bar may include a plurality of insertion prongs extending therefrom, each insertion prong press fit into a respective recess formed in the interior surface of the housing base plate.

According to a further aspect of the present invention, the housing may include a base plate having a surface facing the holder and a holder support frame extending from each comer of the housing base plate, and brackets provided on external surfaces of walls of the holder, wherein the holder support frames engage respective brackets to position the housing and the holder together. Further, the electrical connector box may further include a plurality of divider walls provided in the internal space of the holder defining a top row of horizontally stacked terminal receptacles, each terminal receptacle configured to receive a female terminal connector therein.

A further aspect of the present invention provides a method of assembling an electrical connector box, the electrical connector box including a housing and a plurality of bus bars press fit into the housing, wherein each bus bar includes a connector band and a plurality of bus bar tabs extending therefrom at first uniform intervals and each bus bar is press fit into the housing so that the bus bar extends in a vertical Y-axis direction and the plurality of bus bars are spaced from each other at second uniform intervals along a horizontal X-axis direction substantially perpendicular to the vertical Y-axis direction, a plurality of block connectors configured to hold a plurality of wire terminal connectors attached to the ends of wires, each block connector including a single row of terminal sockets, each terminal socket having a female terminal connector inserted and locked therein, and a holder configured to be joined to the housing, the holder including a plurality of partition walls dividing the internal space of the holder and defining a plurality of vertically stacked receptacles therein, each receptacle configured to receive a block connector therein, the method including inserting the female terminal connectors with wires attached thereto into the block connectors; inserting each block connector into one of the vertically stacked receptacles in the holder; inserting a continuity test probe into each terminal socket of the block connectors and conducting a continuity test; and joining and locking the holder to the housing. Further, the housing may include a base plate having an interior surface facing the holder and a plurality of recesses provided in the interior surface, and the method may further include press fitting the bus bars into the recesses. Further, the electrical connector box may further include lock tabs provided on external surfaces of opposite sidewalls of the holder and latch frames extending from edges of the housing base plate, and the method may further include engaging the lock tabs and respective latch frames to lock the housing and the holder together. Additionally, each bus bar may include a plurality of insertion prongs extending therefrom, and the method may further include press fitting each insertion prong into a respective recess formed in the interior surface of the housing base plate.

According to a further aspect of the present invention, the electrical connector box may further include lock tabs provided on external surfaces of opposite sidewalls of each block connector and lock slots extending along opposite sidewalls of each receptacle, and the method may further include engaging the lock tabs and respective lock slots to lock each block connector in a respective receptacle. Further, the housing may include a base plate having a surface facing the holder and a holder support frame extending from each corner of the housing base plate and brackets provided on external surfaces of walls of the holder, and the method may further include engaging the holder support frames and respective brackets to position the housing and the holder together.

BRIEF DESCRIPTION OF THE DRAWINGS

The above, and other objects, features and advantages of the present invention will be made apparent from the following description of the preferred embodiments, given as nonlimiting examples, with reference to the accompanying drawings in which.

DETAILED DESCRIPTION OF THE INVENTION

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description is taken with the drawings making apparent to those skilled in the art how the forms of the present invention may be embodied in practice.

Figure 1:
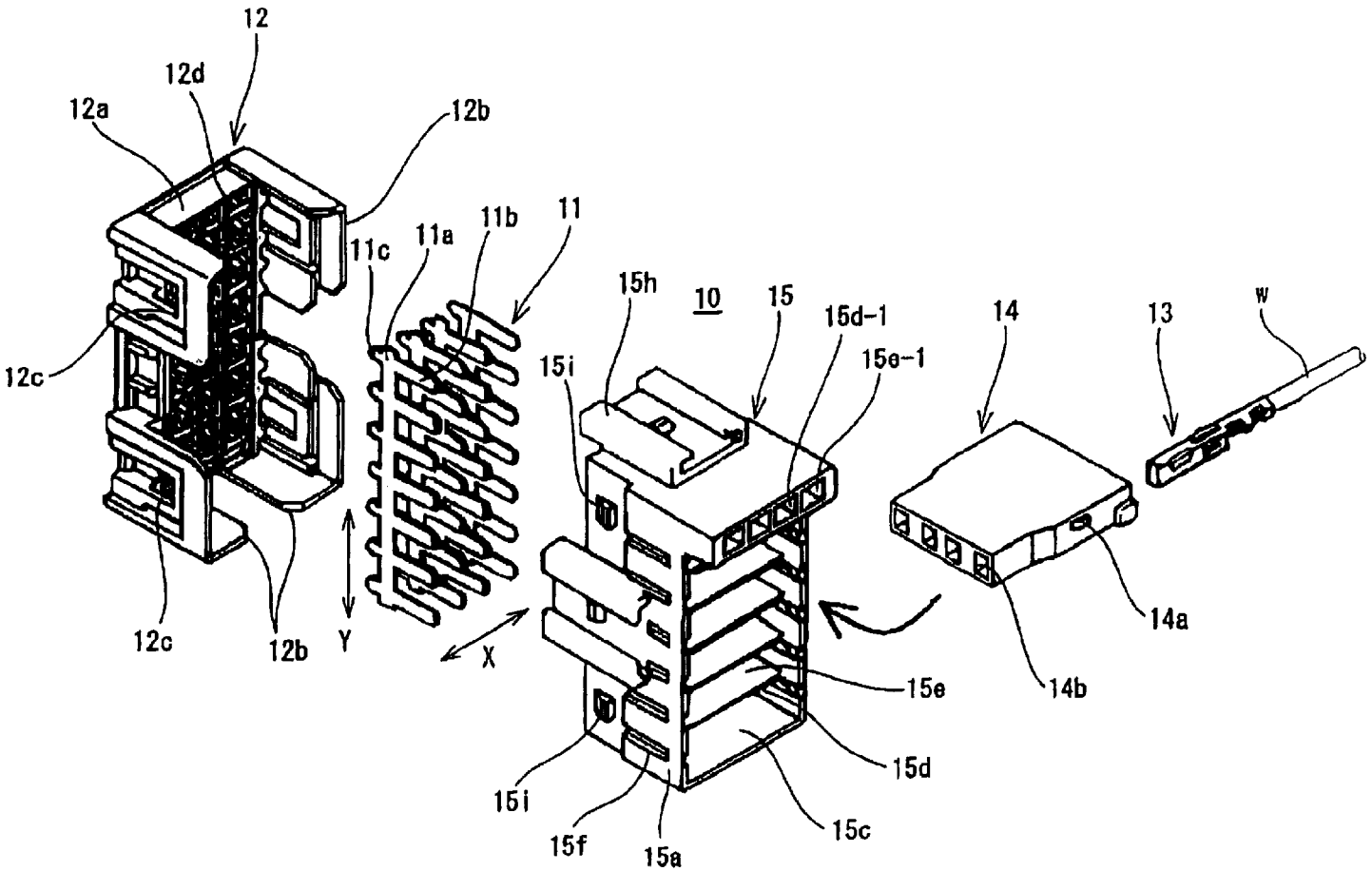
FIG. 1 is an exploded perspective view of the connector box according to an embodiment of the present invention.
Figure 2A:
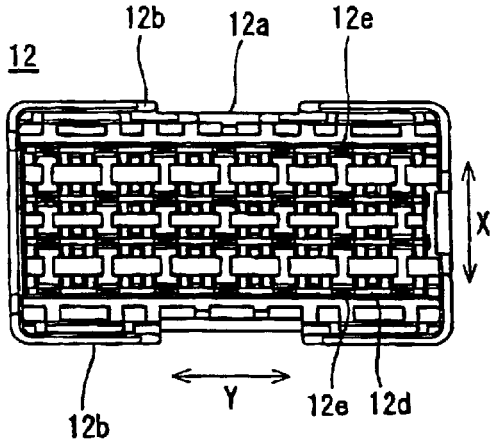
FIG. 2A is a top plan view of the housing portion of the connector box of the embodiment of FIG. 1.
Figure 2B:
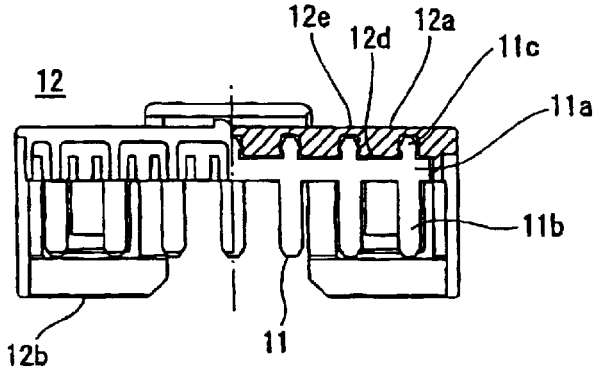
FIG. 2B is a cross sectional side view of the housing portion of the connector box of the embodiment of FIG. 1.
Figure 2C:
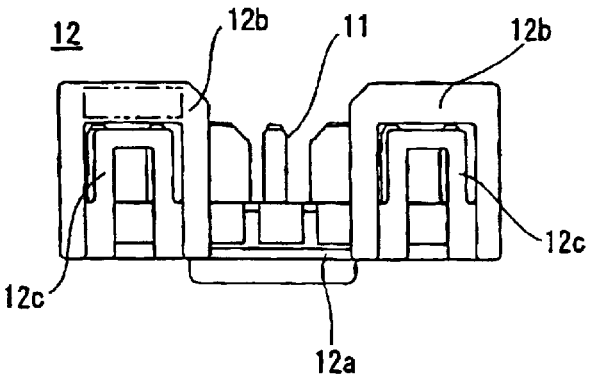
FIG. 2C is an elevational side view of the housing portion of the connector box of the embodiment of FIG. 1, rotated 180° from the view of FIG. 2B.
Figure 2D:
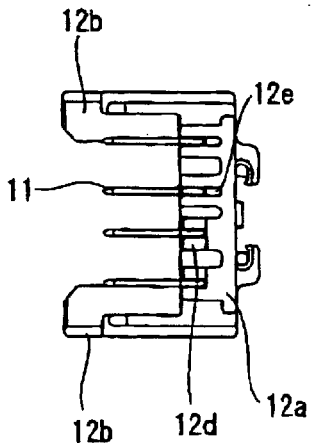
FIG. 2D is an elevational end view of the housing portion of the connector box of the embodiment of FIG. 1.

The following will describe various embodiments of the electrical connector box of the present invention with reference to the attached drawings. FIG. 1 illustrates connector box 10 which includes multiple bus bars 11 that are press fit into housing 12, block connectors 14 which contain female terminal connectors 13 to which wires w are attached, and holder 15 which contains vertically stacked receptacles into which block connectors 14 are inserted.

As shown in FIGS. 2A–2D, housing 12 is formed in a one piece construction that includes base plate 12*a* including corner portions having holder support frames 12*b* extending therefrom, and a flexible latch frame 12*c* formed on an interior side of each holder support frame 12*b*. Channels 12*d* are formed on an internal surface of base plate 12*a* and extend in a Y-axis direction substantially parallel to the direction of the length of bus bars 11, and spaced at uniform intervals along the X-axis. Insertion recesses or indents 12*e* are formed at uniform intervals along and within the floor of each channel 12*d*, and are uniformly spaced along the X-axis. Recesses 12*e* are thus aligned at uniform intervals along both the X- and Y axes to form a grid pattern of recesses.

Each bus bar 11 is press-blanked from an electrically conductive metal sheet into a shape wherein bus bar tabs 11*b* extend at uniform intervals from one side of the vertical or Y-axis oriented connector band 11*a* as illustrated in FIG. 1. The bus bars 11 of the present invention may include any suitable number of tabs 11*b*, and in the present embodiment, includes seven tabs 11*b*. Further, insertion prongs 11*c* extend from the side of connector band 11*a* opposite to tabs 11*b*.

Each bus bar 11 is positioned by placing connector band 11*a* into a channel 12*d*, and securely installing the connector band 11*a* in the housing 12 by press fitting prongs 11*c* into recesses 12*e*. Once installed in housing 12, each bus bar 11 is thus aligned along the Y-axis with tabs 11*b* protruding at uniform intervals along the Y-axis. Bus bars 11 are also spaced at uniform intervals along the X-axis, thus forming a grid-like pattern in which tabs 11*b* are spaced uniformly along both the X- and Y-axes. Additionally, each bus bar 11 can be severed at an appropriate point on connector band 11*a* between tabs 11*b* to form a desired circuit connection, and the severed parts press fit into housing 10.

Figure 3A:
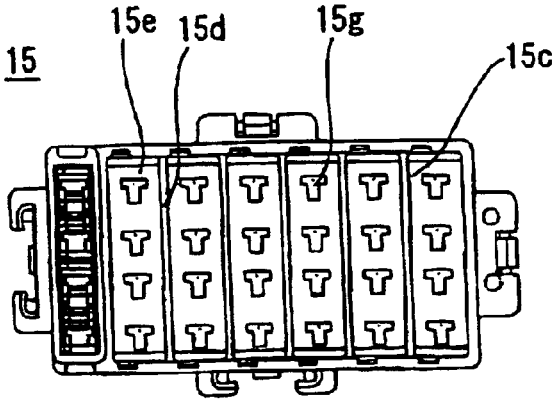
FIG. 3A is a top plan view of the holder portion of the connector box of the embodiment of FIG. 1.
Figure 3B:
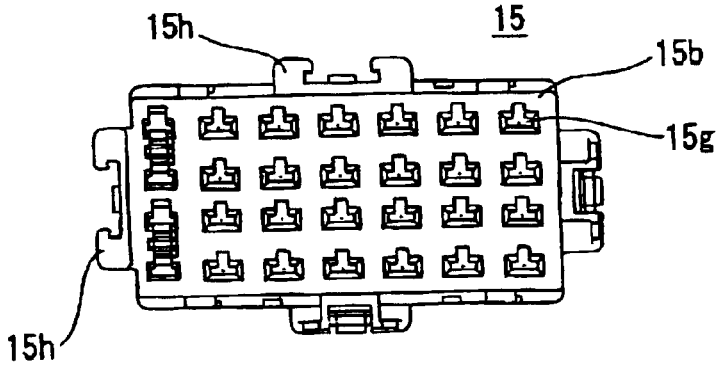
FIG. 3B is a bottom plan view of the holder portion of the connector box of the embodiment of FIG. 1.
Figure 3C:
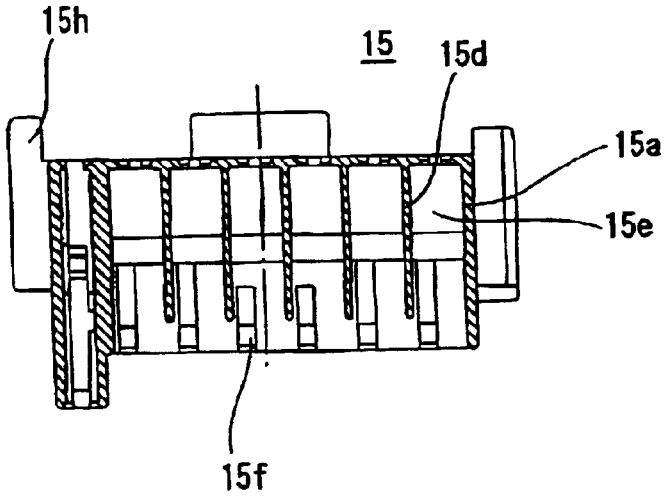
FIG. 3C is a cross sectional side view of the holder portion of the connector box of the embodiment of FIG. 1.

FIGS. 3A–3C illustrate holder 15 as substantially rectangular in shape defined by external walls 15*a* and sealed at the bottom by rear wall 15*b*. The holder 15 may be constructed of any suitable material such as, for example, plastic resin. Connector insertion openings 15*c* open to the side of housing 10 opposite rear wall 15*b*. Partition walls 15*d* extend along the horizontal or X-axis and divide the interior region of holder 15 along the vertical or Y-axis into terminal receptacles 15*e* to form a vertical stack of terminal receptacles 15*e*. The holder 15 of the present invention may include any suitable number of terminal receptacles 15*e*, and in the present embodiment, includes seven terminal receptacles 15*e*. Divider walls 15*d*-1 define a row of top terminal receptacles 15*e*-1 that are smaller than terminal receptacles 15*e*. Lock slots 15*f* are formed within external wall 15*a* at locations bordering terminal receptacles 15*e*, and fixedly connect to lock tabs 14*a* on block connectors 14 with the insertion of block connectors 14 to receptacles 15*e*. In the present invention, lock slots 15*f* may be provided within the external walls 15*a* on both sides of the holder 15 bordering terminal receptacles 15*e* to fixedly connect to lock tabs 14*a* provided on both sides of the block connectors 14.

Multiple T-shaped terminal access ports 15*g*, which are formed within rear wall 15*b* of holder 15 that faces housing 12, are aligned in rows in terminal receptacles 15*e*. The holder 15 of the present invention may include any suitable number of terminal access ports 15*g*, and in the present embodiment, include a row of four terminal access ports 15*g* in each terminal receptacle 15*e*. Bus bar tabs 11*b* are inserted in terminal access ports 15*g*, and a continuity test probe (not shown in the figures) may also be inserted therein.

A bracket 15*h* is provided on each external wall 15*a* of holder 15, extending toward housing 12 and, when assembled, is positioned between holder support frames 12*b*. A pair of lock tabs 15*i* is provided on each of the two external walls 15*a* on the sides of the holder 15, i.e., on the externals walls 15*a* that extend in the Y-axis direction as shown in FIG. 1, at points corresponding to the positions of latch frames 12*c* on holder support frames 12*b*.

Each block connector 14, which is inserted in and is joined to a terminal receptacle 15*e*, contains a single row of horizontal or X-axis aligned multiple terminal sockets 14*b*, each housing a female terminal connector 13. The block connectors 14 of the present invention may include any suitable number of terminal sockets 14*b*, and in the present embodiment, include four terminal sockets 14*b*. The terminal ends of branch wires w, which lead from the wiring harness, are crimped to terminal connectors 13. Further, top terminal receptacles 15*e*-1 are provided as individual receptacles through which single-pole terminal connectors may be joined to the connector box.

Figure 4A:
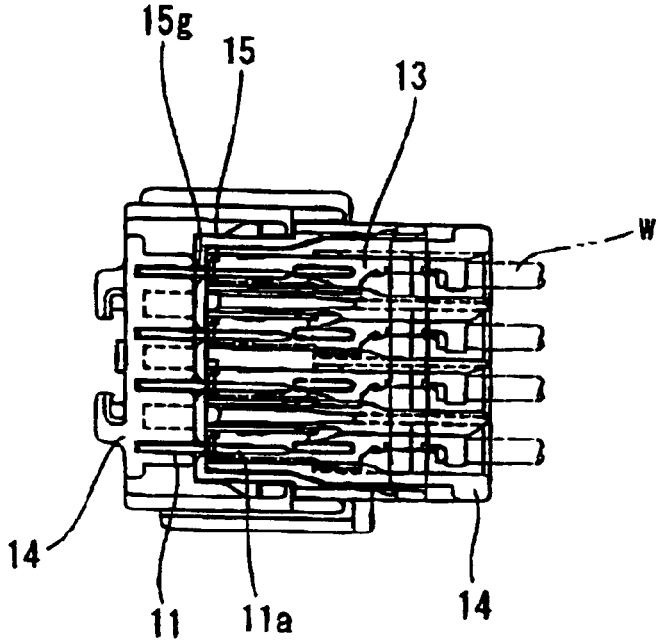
FIG. 4A is a cross sectional side view of the connector box of the embodiment of FIG. 1, showing the holder and housing joined together.
Figure 4B:
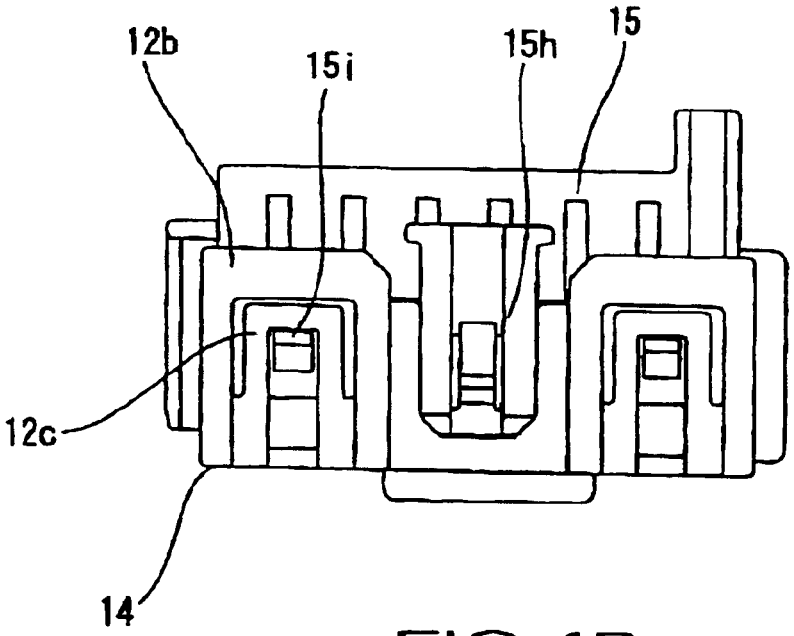
FIG. 4B is an elevational side view of the holder and housing of the connector box of the embodiment of FIG. 1, showing the holder and housing joined together.
Figure 5:
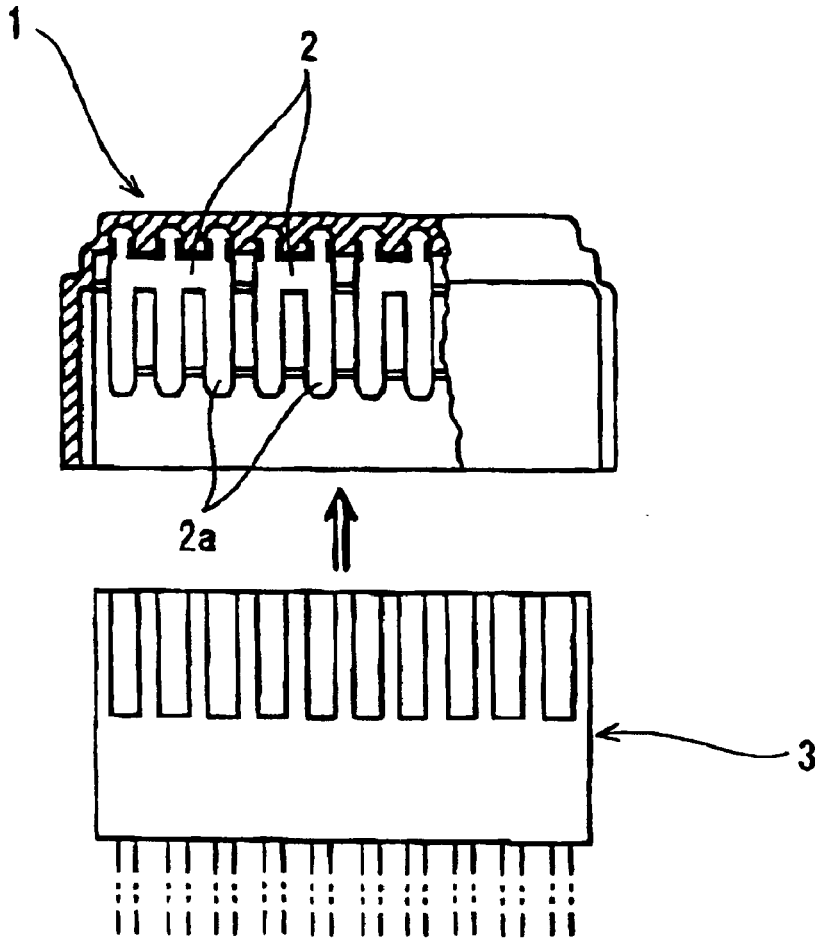
FIG.5 PRIOR ART
FIG. 5 is an exploded elevational side view of a conventional connector box.

The following will explain, with reference to FIG. 4, the procedure through which connector box 10 is assembled. Any of bus bars 11 can be modified to a desired circuit connecting configuration by severing connector band 11*a* at a specific location. The severed bus bars 11 are installed in housing 12 by press fitting insertion prongs 11*c* into recesses 12*e* of housing 12, thus forming a structure whereby tabs 11*b* protrude from within housing 12. The desired circuit connection pattern may also dictate that one or more bus bars 11 be installed within housing 12 in an un-severed condition.

Female terminal connectors 13, with wires w attached thereto, are then inserted in and locked to block connectors 14. It is not required that the wires for connection be inserted and locked to the same block connector 14. Wires for connection can be inserted and locked to other block connectors 14 within the same row in any block connector (for example, the terminal sockets located at the extreme left side of block connectors 14).

Each block connector 14 is then inserted and locked into a terminal receptacle 15*e* of holder 15, thus forming a structure in which multiple block connectors 14 are positioned in a vertically stacked configuration within terminal receptacles 15*e*. With block connectors 14 thus inserted, each female terminal connector 13 within block connector 14 aligns with a terminal access port 15*g* formed in rear wall 15*b* of holder 15.

A continuity test is then performed with block connectors 14 installed in holder 15 in the configuration described above. The continuity check can be performed on wires w by inserting continuity probes (not shown in the drawings) through terminal access ports 15*g*. This is made possible by female terminal connectors 13 being positioned within terminal access ports 15*g* through the indexing of each block connector 14 to holder 15.

Once continuity has been checked, holder 15 and housing 12 are brought together to form an assembly. The installation of holder 15 in housing 12 results in bus bar tabs 11*b* being connected to their corresponding female terminal connectors 13 through terminal access ports 15*g* provided in holder 15. With the connection thus established, lock tabs 15*i* on holder 15 have engaged and locked to latch frames 12*c* of housing 12, thus completing the assembly of connector box 10.

As described above, connector box 10 is an assembled structure, consisting primarily of holder 15 and housing 12, which allows multiple circuit connections to be made simultaneously with the joining of holder 15 to housing 12, thus providing for an extremely simple method of connecting multiple circuits. Moreover, alterations to a circuit connection pattern can be easily executed by changing the location where bus bar 11 is severed, thus, in most cases, eliminating the need to change the positions of the wires in block connectors 14. The wires in block connectors 14 can be changed, however, in cases where a desired alteration to the circuit connection pattern cannot be performed by severing the bus bar.

Moreover, the need to use a support jig to conduct a continuity check on block connectors 14 is eliminated because the continuity test can be performed with multiple block connectors 14 installed to holder 15, thus making the continuity check a fast and simple operation.

In the above-described embodiment, connector box 10 may also be assembled through a sequential procedure in which bus bars 11 are installed in housing 12, housing 12 is joined to holder 15, and block connectors 14 are inserted into holder 15 to join female terminal connectors 13 to bus bar tabs 11*b*.

As described above, the connector box invention puts forth a single connector box capable of providing multiple circuit connections that previously required multiple connector boxes located at various places throughout the wiring harness. The invention also eliminates the need to place the wires for connection within a single connector, and shortens wire routing paths to allow the use of shorter wire lengths. In addition, the invention makes it possible to quickly and easily establish circuit connections by connecting multiple bus bar tabs to multiple female terminal connectors on wire ends through the joining of the housing and the holder. Still further, the invention makes it easy to alter circuit connection patterns by simply severing the bus bars at desired locations.

Each block connector need not be placed in a continuity test jig because the connected circuit continuity test can be conducted with multiple block connectors already inserted in the holder, thus allowing the continuity test to be executed faster and with increased productivity.

Although the invention has been described with reference to an exemplary embodiment, it is understood that the words that have been used are words of description and illustration, rather than words of limitation. Changes may be made within the purview of the appended claims, as presently stated and as amended, without departing from the scope and spirit of the invention in its aspects. Although the invention has been described with reference to particular means, materials and embodiments, the invention is not intended to be limited to the particulars disclosed. Rather, the invention extends to all functionally equivalent structures, methods, and uses such as are within the scope of the appended claims.

The present disclosure relates to subject matter contained in priority Japanese Application No. 2002-238498, filed on Aug. 19, 2002, which is herein expressly incorporated by reference in its entirety.

What is claimed is:

1. An electrical connector box comprising:

a housing;

a plurality of bus bars press fit into said housing, wherein each bus bar includes a connector band and a plurality of bus bar tabs extending therefrom at first uniform intervals and each bus bar is press fit into the housing so as to extend in a vertical Y-axis direction and the plurality of bus bars are spaced from each other at second uniform intervals along a horizontal X-axis direction substantially perpendicular to the vertical Y-axis direction;

a plurality of block connectors configured to hold a plurality of female terminal connectors attached to the ends of wires, each block connector including a single row of terminal sockets, each terminal socket having a female terminal connector inserted and locked therein; and a holder joined to said housing, said holder including a plurality of partition walls dividing the internal space of said holder and defining a plurality of vertically stacked receptacles therein, each receptacle configured to receive a block connector therein;

wherein each said block connector is individually positioned in one of said vertically stacked receptacles within said holder so that said bus bar tabs are positioned in and joined to respective female terminal connectors in said block connectors.

2. The electrical connector box according to claim 1, said electrical connector box further comprising:

lock tabs provided on external surfaces of opposite sidewalls of each said block connector; and lock slots extending along opposite sidewalls of each said receptacle, wherein said lock tabs engage respective said lock slots to lock each said block connector in a respective said receptacle.

3. The electrical connector box according to claim 1, said holder including a rear wall having an exterior surface facing said housing and a plurality of terminal connector access ports provided in said exterior surface facing said housing, each said terminal connector access port configured to receive therein one of said bus bars tabs and a continuity test probe.

4. The electrical connector box according to claim 1, said housing including a base plate having a surface facing said holder and a holder support frame extending from each corner of said housing base plate; and brackets provided on external surfaces of walls of said holder, wherein said holder support frames engage respective said brackets to position said housing and said holder together.

5. The electrical connector box according to claim 1, said electrical connector box further comprising:

a plurality of divider walls provided in said internal space of said holder defining a top row of horizontally stacked terminal receptacles, each terminal receptacle configured to receive a female terminal connector therein.

6. The electrical connector box according to claim 1, wherein said first uniform intervals between said bus bar tabs and said second uniform intervals between said bus bars are substantially equal.

7. The electrical connector box according to claim 1, said housing including a base plate having an interior surface facing said holder and a plurality of recesses provided in said interior surface, said bus bars press fit into said recesses.

8. The electrical connector box according to claim 7, said electrical connector box further comprising:

lock tabs provided on external surfaces of opposite sidewalls of said holder; and latch frames extending from edges of said housing base plate, wherein said lock tabs engage respective said latch frames to lock said housing and said holder together.

9. The electrical connector box according to claim 7, where each said bus bar includes a plurality of insertion prongs extending therefrom, each said insertion prong press fit into a respective said recess formed in said interior surface of said housing base plate.

10. A method of assembling an electrical connector box, said electrical connector box including a housing and a plurality of bus bars press fit into said housing, wherein each bus bar includes a connector band and a plurality of bus bar tabs extending therefrom at first uniform intervals and each bus bar is press fit into the housing so as to extend in a vertical Y-axis direction and the plurality of bus bars are spaced from each other at second uniform intervals along a horizontal X-axis direction substantially perpendicular to the vertical Y-axis direction, a plurality of block connectors configured to hold a plurality of female terminal connectors attached to the ends of wires, each block connector including a single row of terminal sockets, and a holder configured to be joined to said housing, said holder including a plurality of partition walls dividing the internal space of said holder and defining a plurality of vertically stacked receptacles therein, each receptacle configured to receive a block connector therein, said method comprising:

inserting said female terminal connectors with wires attached thereto into said block connectors;

inserting each said block connector into one of said vertically stacked receptacles in said holder;

inserting a continuity test probe into each said terminal socket of said block connectors and conducting a continuity test; and joining and locking said holder to said housing.

11. The method of assembling an electrical connector box according to claim 10, the electrical connector box further including lock tabs provided on external surfaces of opposite sidewalls of each block connector and lock slots extending along opposite sidewalls of each receptacle, said method further comprising:

engaging said lock tabs and respective said lock slots to lock each said block connector in a respective said receptacle.

12. The method of assembling an electrical connector box according to claim 10, said housing including a base plate having a surface facing the holder and a holder support frame extending from each corner of said housing base plate and brackets provided on external surfaces of walls of said holder, said method further comprising:

engaging said holder support frames and respective said brackets to position said housing and said holder together.

13. The method of assembling an electrical connector box according to claim 10, wherein said housing includes a base plate having an interior surface facing said holder and a plurality of recesses provided in said interior surface, said method further comprising:

press fitting said bus bars into said recesses.

14. The method of assembling an electrical connector box according to claim 13, the electrical connector box further including lock tabs provided on external surfaces of opposite sidewalls of the holder and latch frames extending from edges of the housing base plate, said method further comprising:

engaging said lock tabs and respective said latch frames to lock said housing and said holder together.

15. The method of assembling an electrical connector box according to claim 13, wherein each bus bar includes a plurality of insertion prongs extending therefrom, said method further comprising:

press fitting each said insertion prong into a respective said recess formed in the interior surface of said housing base plate.

* * * * *